US012070071B2

(12) United States Patent
Liu

(10) Patent No.: US 12,070,071 B2
(45) **Date of Patent: *Aug. 27, 2024**

(54) ELECTRONIC HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 649 days.

This patent is subject to a terminal disclaimer.

(21) Appl. No.: 17/123,062

(22) Filed: Dec. 15, 2020

(65) Prior Publication Data

US 2022/0061391 A1 Mar. 3, 2022

(30) Foreign Application Priority Data

Aug. 25, 2020 (CN) ..... 202010864531.0
Aug. 25, 2020 (CN) ..... 202021794112.6

(51) Int. Cl.
*A24F 40/465* (2020.01)
*A24F 1/30* (2006.01)
*A24F 40/60* (2020.01)

(52) U.S. Cl.
CPC ..... *A24F 40/465* (2020.01); *A24F 1/30* (2013.01); *A24F 40/60* (2020.01)

(58) Field of Classification Search
CPC ..... A24F 1/30; A24F 40/60; A24F 40/465
See application file for complete search history.

(56) References Cited

U.S. PATENT DOCUMENTS

2010/0212678 A1* 8/2010 Bishara ..... A24F 1/30 131/173
2017/0251718 A1* 9/2017 Armoush ..... A24F 1/30
2018/0007974 A1* 1/2018 Thorens ..... A24F 47/00
2018/0338535 A1* 11/2018 Li ..... A24F 47/00
2021/0386120 A1* 12/2021 Gill ..... A24F 40/465

* cited by examiner

*Primary Examiner* — Christopher M Rodd
*Assistant Examiner* — Daniel Edward Vakili
(74) *Attorney, Agent, or Firm* — MATTHIAS SCHOLL P.C.; Matthias Scholl

(57) ABSTRACT

An electronic hookah includes a main part, a smoke filter, and a connection part connecting the main part and the smoke filter. The main part includes a high-frequency heating unit. The high-frequency heating unit includes a heating cup and a magnetic induction coil. The heating cup is disposed in the magnetic induction coil and is configured to accommodate a tobacco material.

10 Claims, 4 Drawing Sheets

ELECTRONIC HOOKAH

CROSS-REFERENCE TO RELAYED APPLICATIONS

Pursuant to 35 U.S.C. § 119 and the Paris Convention Treaty, this application claims foreign priority to Chinese Patent Application No. 202010864531.0 filed on Aug. 25, 2020, and to Chinese Patent Application No. 202021794112.6 filed on Aug. 25, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to an electronic hookah.

SUMMARY

The disclosure provides an electronic hookah, comprising a main part, a smoke filter, and a connection part connecting the main part and the smoke filter; the main part comprises a high-frequency heating unit; the high-frequency heating unit comprises a heating cup and a magnetic induction coil; and the heating cup is disposed in the magnetic induction coil and is configured to accommodate a tobacco material.

In a class of this embodiment, the main part is L-shaped.

In a class of this embodiment, the connection part comprises a silicone sleeve and an adapter; the adapter comprises a first end and a second end; the first end is fixedly connected to the main part; the silicone sleeve is disposed around the second end of the adapter to seal a gap between the adapter and an opening of the smoke filter; and the adapter and the silicone sleeve as a whole are detachable from the smoke filter.

In a class of this embodiment, the connection part further comprises a gas tube fixed in the adapter for air conduction.

In a class of this embodiment, the main part further comprises a power switching unit configured to adjust a heating power of the magnetic induction coil to adapt to different tobacco materials.

In a class of this embodiment, the high-frequency heating unit further comprises a glass sleeve disposed between the heating cup and the magnetic induction coil to protect the heating cup and the magnetic induction coil.

In a class of this embodiment, the heating cup comprises glass with an inlaid metal.

In a class of this embodiment, the heating cup comprises a top opening and a sealed end, or the heating cup comprises a top end and a bottom end, and the top end and the bottom end both comprise holes.

In a class of this embodiment, the main part comprises a fixed ring, a silicone spring, a silicone ring, a top cover, and a button; the button is disposed on the top cover; the silicone spring is disposed on a bottom of the button; the top cover is disposed on the fixed ring; the silicone ring is disposed between the top cover and the fixed ring; the button is movable up and down with respect to the top cover whereby a gap between the button and the top cover is adjustable to control an air intake amount the device.

In a class of this embodiment, the smoke filter comprises a first air tube, a second air tube, and a flask containing water; the first air tube comprises a first end connected to the adapter and a second end submerged into water of the flask; the second air tube comprises a first end connected to a mouthpiece and a second end disposed in the flask and above the water; when in use, smoke produced in the main part flows through the connection part and enters the smoke filter and is filtered by water.

In a class of this embodiment, the main part comprises a switching button configured to switch an output power of the device to adapt to different tobacco materials.

In a class of this embodiment, the main part comprises a temperature sensor configured to transmit a temperature signal to a power switching unit when a working temperature of the device reaches a set value.

In a class of this embodiment, the main part comprises a control panel and a battery soldered on the control panel.

DETAILED DESCRIPTION

To further illustrate, embodiments detailing an electronic hookah are described below. It should be noted that the following embodiments are intended to describe and not to limit the disclosure.

Tobacco materials refer to tobacco tar, tobacco paste, tobacco leaf and other materials used to produce smoke.

Figure 1:
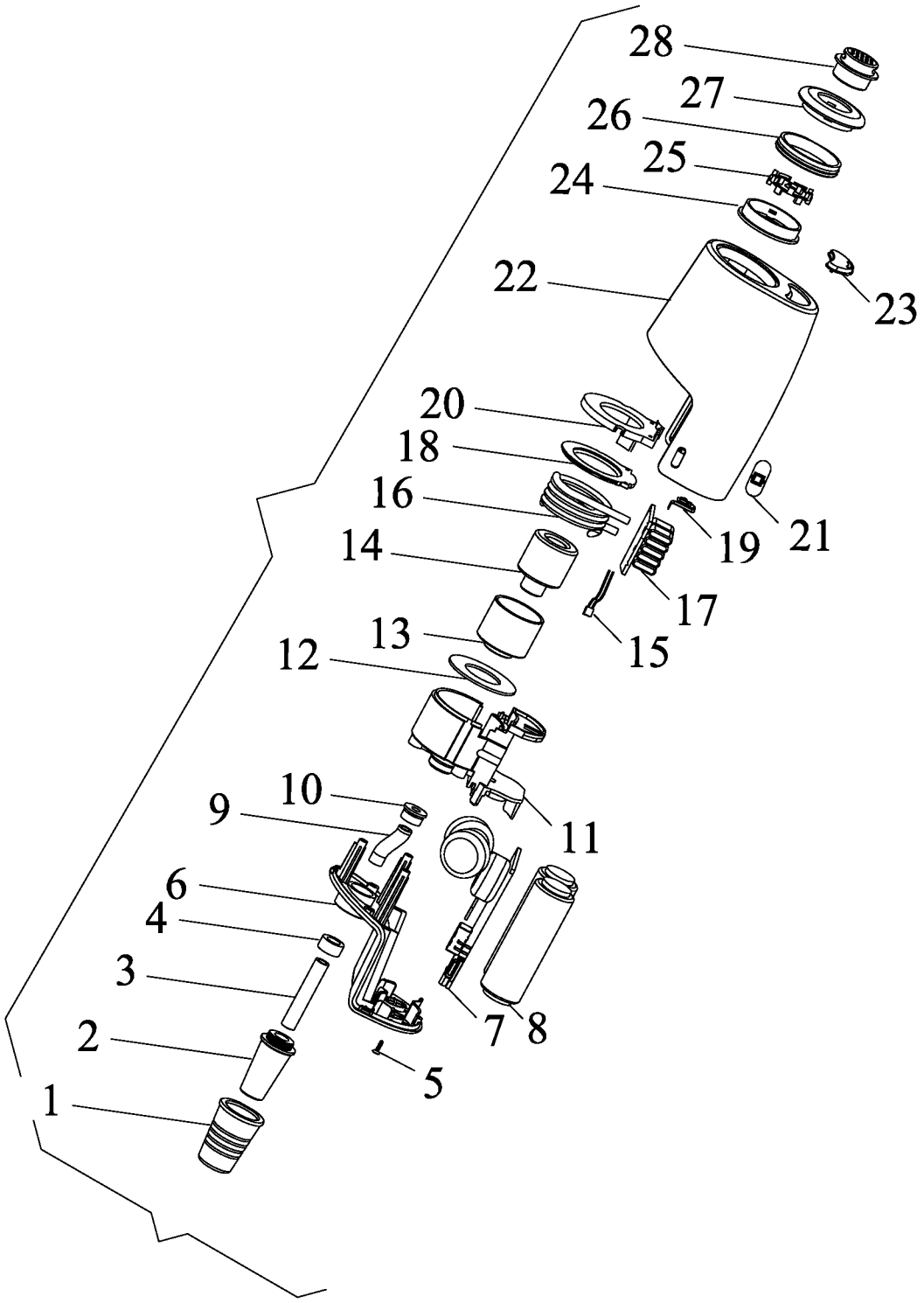
FIG. 1 is an exploded view of a main part and a connection part of an electronic hookah in accordance with one embodiment of the disclosure.
Figure 2:
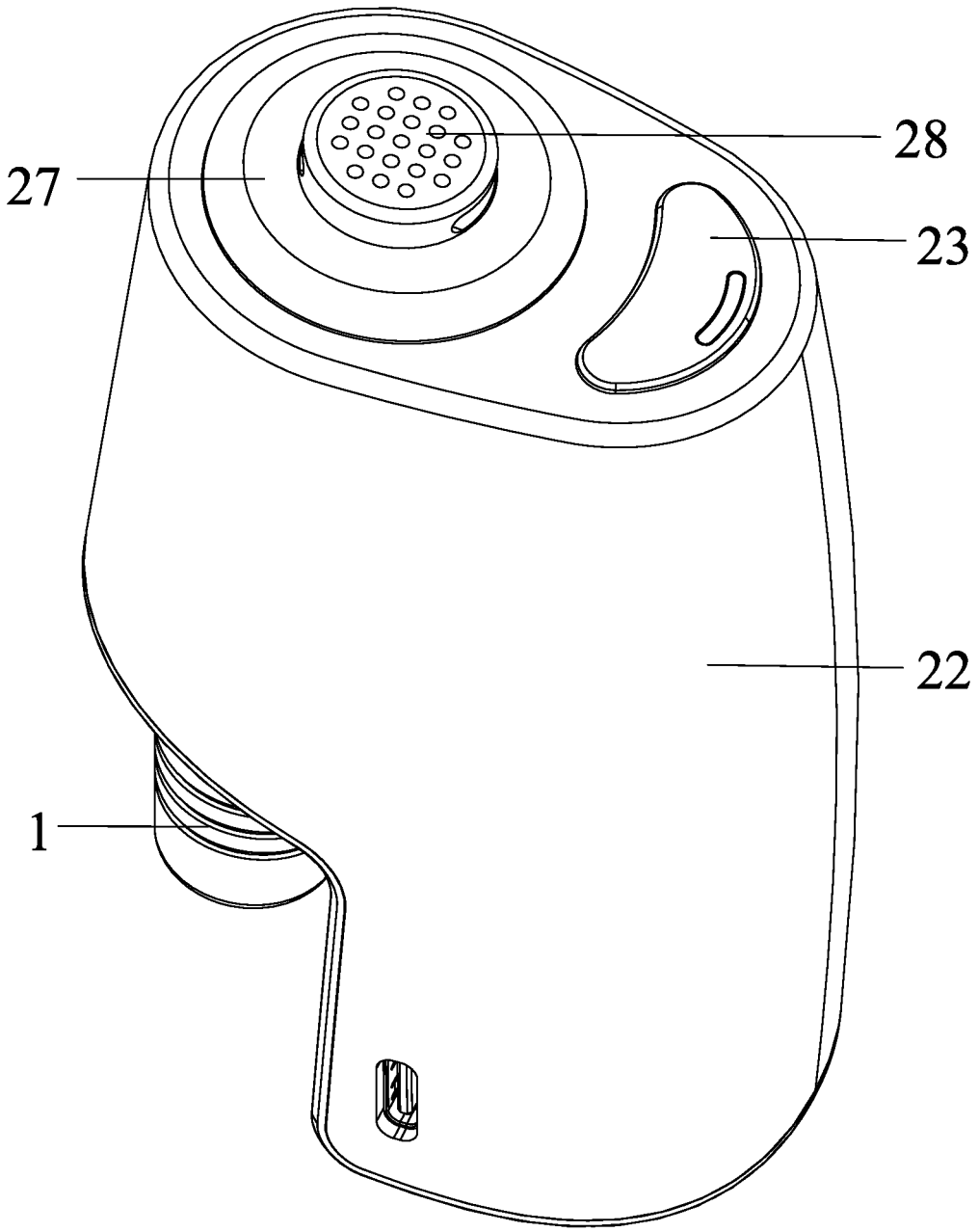
FIG. 2 is a schematic diagram of a main part and a connection part of an electronic hookah in accordance with one embodiment of the disclosure.
Figure 3:
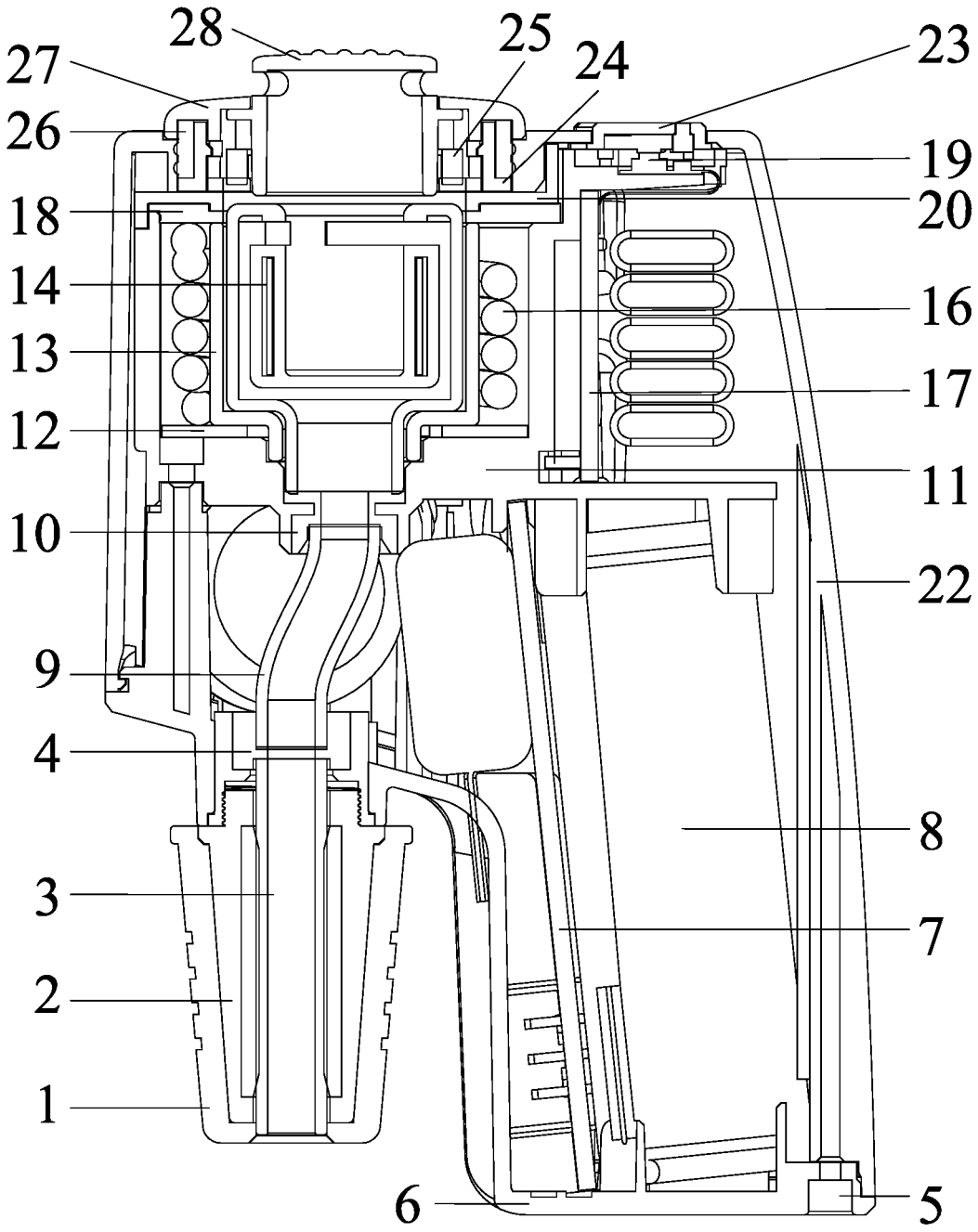
FIG. 3 is a sectional view of a main part and a connection part of an electronic hookah in accordance with one embodiment of the disclosure.
Figure 4:
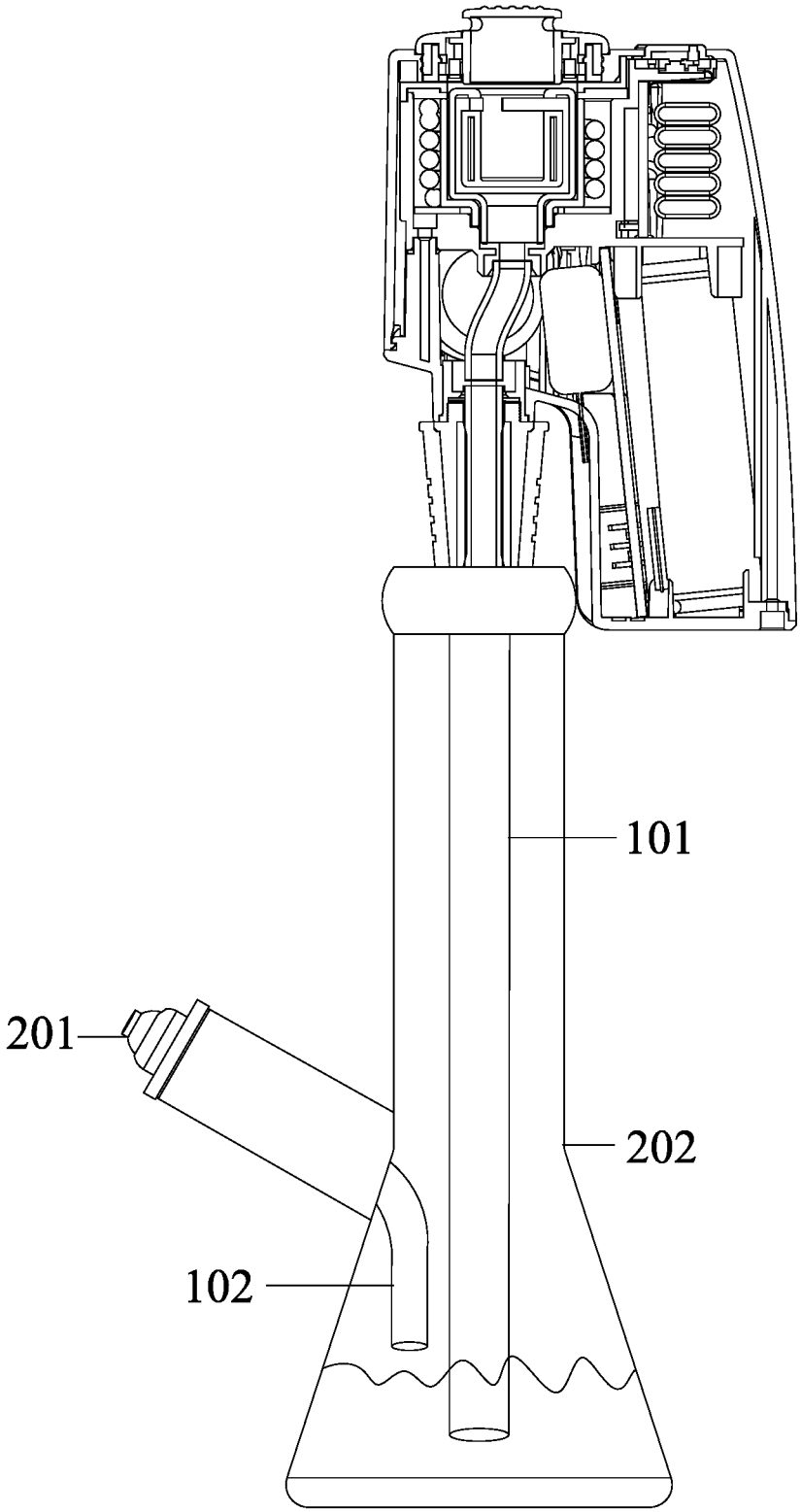
FIG. 4 is a schematic diagram of an electronic hookah in accordance with one embodiment of the disclosure.

As shown in FIGS. 1-4, the disclosure provides an electronic hookah comprises a silicone sleeve 1, an adapter 2, a gas tube 3, a silicone switch 4, a screw 5, a bottom cover 6, a control panel 7, a battery 8, a bended glass 9, a first silicone gasket 10, a support 11, a second silicone gasket 12, a glass sleeve 13, a heating cup 14, a temperature sensor 15, a magnetic induction coil 16, a power panel 17, a silicone thermal insulator 18, a power contact 19, a heat filter 20, a switching button 21, a housing 22, a power button 23, a fixed ring 24, a silicone spring 25, a silicone ring 26, a top cover 27, and a button 28. The bottom cover 6 is fixed on the housing 22 through the screw 5. The top cover 27 and the bottom cover 6 form an L-shaped structure. The heating cup 14 comprises glass with an inlaid metal. In certain embodiments, the heating cup 14 is made of ceramics, quartz, or crystal with inlaid metal. The glass sleeve 13 disposed between the heating cup 14 and the magnetic induction coil 16 to protect the heating cup 14 and the magnetic induction coil 16. The second silicone gasket 12 is disposed in the support 11 to fix the magnetic induction coil 16. The power panel 17 is disposed on the support 11 and the output end of the power panel is soldered on the lead of the magnetic induction coil 16. The temperature sensor 15 is fixed on the bottom of the glass sleeve 13 and the lead of the temperature sensor 15 is soldered on the temperature control circuit of the power panel 17 for over-temperature protection. The power contact 19 is disposed on the power panel 17 to control the opening and closing of the power source. The heat filter 20 is disposed on the silicone thermal insulator 18 and the silicone thermal insulator 18 is disposed on the magnetic induction coil 16 for thermal insulation. The first silicone gasket 10 is disposed on the support 11 and between the glass sleeve 13 and the bended glass 9. The glass sleeve 13 communicates with the bended glass 9 through the first silicone gasket 10. The gas tube 3 runs through the adapter 2 and is fixed on the adapter 2. The silicone switch 4 is disposed around a joint of the gas tube 3 and the bended glass 9. The adapter 2 is in threaded connection to the bottom cover 6. The silicone sleeve 1 is disposed around the adapter 2 to seal the gap between the adapter 2 and the smoke filter. The adapter 2 and the silicone sleeve 1 as a whole are detachable from the smoke filter. The button 28 is disposed on the top cover 27; the silicone spring 25 is disposed on a bottom of the button 28; the top cover is disposed on the fixed ring 24; the silicone ring 26 is disposed between the top cover 27 and the fixed ring 24; the button 28 is movable up and down with respect to the top cover 27 whereby a gap between the button 28 and the top cover 27 is adjustable to control the air intake amount the electronic hookah. The power button 23 is disposed on the housing 22 and is connected to the power contact 19. The control panel 7 is fixed in the bottom cover 6. The battery 8 is fixed in the bottom cover 6. The positive and negative terminals of the battery 8 are soldered on the input end of the control panel 7. The switching button 21 is disposed in the housing 22 and contacts a power switching button on the control panel 7.

The smoke filter comprises a first air tube 101, a second air tube 102, and a flask 202 containing water; the first air tube 101 comprises a first end connected to the adapter 2 and a second end submerged into water of the flask; the second air tube 102 comprises a first end connected to a mouthpiece 201 and a second end disposed in the flask and above the water; when in use, smoke produced in the main part flows through the connection part and enters the smoke filter and is filtered by water.

The following advantages are associated with the electronic hookah of the disclosure:

1. The electronic hookah comprises a high-frequency heating unit comprising the heating cup and the magnetic induction coil, thus improving the heating efficiency.

2. The button is movable up and down with respect to the top cover whereby the gap between the button and the top cover is adjustable to control an air intake amount the electronic hookah.

3. The electronic hookah comprises a power switching unit to adjust the heating power of the magnetic induction coil to adapt to different tobacco materials.

4. The heating cup comprises a top opening and a sealed end, or the heating cup comprises a top end and a bottom end, and the top end and the bottom end both comprise holes. In this way, the heating cup can be used for heating tobacco materials to produce liquid products or solid products as needed.

It will be obvious to those skilled in the art that changes and modifications may be made, and therefore, the aim in the appended claims is to cover all such changes and modifications.

What is claimed is:

1. A device, comprising a main part, a smoke filter, and a connection part connecting the main part and the smoke filter; wherein:

the main part comprises a heating cup and a magnetic induction coil; and the heating cup is disposed in the magnetic induction coil and is configured to accommodate a tobacco material;

the heating cup comprises a non-conductive material selected from ceramic, quartz, or glass, and the heating cup comprises a metal inlaid within the non-conductive material; the non-conductive material is adapted to insulate the metal from the tobacco material;

the heating cup comprises a top opening and a sealed end, or the heating cup comprises a top end and a bottom end, and the top end and the bottom end both comprise holes; and the main part comprises a fixed ring, a silicone spring, a silicone ring, a top cover, and a button; the button is disposed on the top cover; the silicone spring is disposed on a bottom of the button; the top cover is disposed on the fixed ring; the silicone ring is disposed between the top cover and the fixed ring; the button is movable up or down with respect to the top cover whereby a second gap between the button and the top cover is adjustable to control an air intake amount of the device.

2. The device of claim 1, wherein the main part is L-shaped.

3. The device of claim 2, wherein the connection part comprises a silicone sleeve and an adapter; the adapter comprises a first end and a second end; the first end is fixedly connected to the main part; the silicone sleeve is disposed around the second end of the adapter to seal a first gap between the adapter and an opening of the smoke filter; and the adapter and the silicone sleeve as a whole are detachable from the smoke filter.

4. The device of claim 3, wherein the connection part further comprises a gas tube fixed in the adapter for air conduction.

5. The device of claim 4, wherein the smoke filter comprises a first air tube, a second air tube, and a flask containing water; the first air tube comprises a first end connected to the adapter and a second end submerged into water of the flask; the second air tube comprises a first end connected to a mouthpiece and a second end disposed in the flask and above the water; when in use, smoke produced in the main part flows through the connection part and enters the smoke filter and is filtered by water.

6. The device of claim 4, wherein the main part comprises a temperature sensor configured to transmit a temperature signal to a power switching unit when a working temperature of the device reaches a set value.

7. The device of claim 4, wherein the main part comprises a control panel and a battery soldered on the control panel.

8. The device of claim 4, wherein the main part further comprises a power switching unit configured to adjust a heating power of the magnetic induction coil to adapt to different tobacco materials.

9. The device of claim 8, wherein the main part comprises a switching button configured to switch an output power of the device to adapt to different tobacco materials.

10. The device of claim 8, wherein a glass sleeve is disposed between the heating cup and the magnetic induction coil to protect the heating cup and the magnetic induction coil.

* * * * *